US005095563A

United States Patent [19]

Miller

[11] Patent Number: 5,095,563

[45] Date of Patent: Mar. 17, 1992

[54] HAMMOCK LIKE PORTABLE INFANT SUSPENDER AND SUPPORT ASSEMBLY

[76] Inventor: Frank M. Miller, Rte. 5, Box 246, Overton Beach, Moncks Corner, S.C. 29461

[21] Appl. No.: 605,758

[22] Filed: Oct. 30, 1990

[51] Int. Cl.[5] ..... A47D 9/00; A45F 3/22

[52] U.S. Cl. ..... 5/101; 5/123; 5/127; 5/425

[58] Field of Search ..... 5/98.3, 101, 108, 120, 5/122, 123, 127, 129, 425; 297/273, 276, 281

[56] References Cited

U.S. PATENT DOCUMENTS

| | | | |
|---|---|---|---|
| 816,340 | 3/1906 | Knoernschild | 5/129 |
| 909,102 | 1/1909 | Maxwell | 5/129 |
| 940,939 | 11/1909 | Patterson | 5/129 |
| 941,927 | 11/1909 | Johnson | 5/129 |
| 1,257,984 | 3/1918 | Drexler | 5/120 |
| 1,320,381 | 11/1919 | Dittrick | 5/129 |
| 1,380,167 | 5/1921 | Wester | 5/122 |
| 1,798,546 | 3/1931 | Lillibridge | 5/129 |
| 2,496,068 | 1/1950 | Rutkowski | 5/425 |
| 2,781,528 | 2/1957 | Lo Vico | 5/122 |
| 4,162,550 | 7/1979 | Willingham | 5/120 |

*Primary Examiner*—Renee S. Luebke
*Assistant Examiner*—F. Saether

[57] ABSTRACT

A portable infant hammock/bassinette and suspension assembly is disclosed comprising a supporting/suspending stand and a bed structure suspended therefrom. Optimally, the framing elements for the stand and the bed are constructed of lightweight PVC furniture pipe in a manner permitting disassembly for ease of portability.

18 Claims, 2 Drawing Sheets

HAMMOCK LIKE PORTABLE INFANT SUSPENDER AND SUPPORT ASSEMBLY

BACKGROUND OF THE INVENTION

1. Field of the Invention

This invention relates generally to a bed and a suspension assembly therefor, more particularly to an infant hammock and a separate frame for suspending the hammock, and most particularly to an infant hammock/bassinett and an assembling/disassembling suspension frame therefor, permitting portability.

2. Description of the Prior Art

Many support articles include means for suspending the article above a floor. The most familiar being various support articles designed to hang from a ceiling. Such devices are disclosed in U.S. Pat. Nos. 4,799,669; 4,825,855; and 4,838,608. More pertinent to this application, a support device taught to be suspended by a separate supporting frame is taught in U.S. Pat. No. 4,807,872. No known prior art suspension support device, however, offers the combination of commonly available assembly pieces (i.e., plastic tubing, or PVC furniture pipe, and twine), a detachable, portable, assembleable suspension frame and, in combination, a simplified, safe infant hammock/bassinett, serving as a portable cradle for a very small child. Additionally, the bed device and supporting frame may be scaled upwardly to provide medical benefits to a youth or adult suffering from severe burns by allowing air to circulate to all portions of the prone body, thereby speeding the healing process.

SUMMARY OF THE INVENTION

The invention portable infant suspender and assembly is comprised of two major components, a supporting-/suspending stand structure and a bed structure suspended therefrom. The suspending structure is formed of a first generally rectangular frame with extensions projecting upward and outward from the end sides of the first rectangular frame. The suspended bed provides support in the form of a netting material stretched across a second rectangular frame and extending beyond the end sides of the bed frame to terminating junctures of the extended netting material. The supporting stand and the bed structure are assembled/disassembled by attachment/detachment of each of the terminating junctures of the netting material to/from each of the supporting frame structure's extensions. When assembled, the bed is suspended within a first horizontal plane formed by the second rectangular frame above a second horizontal plane formed by the first rectangular frame of the supporting structure.

DESCRIPTION OF THE PREFERRED EMBODIMENT(S)

As required, detailed embodiments of the invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the invention in virtually any appropriately detailed structure.

Figure 1:
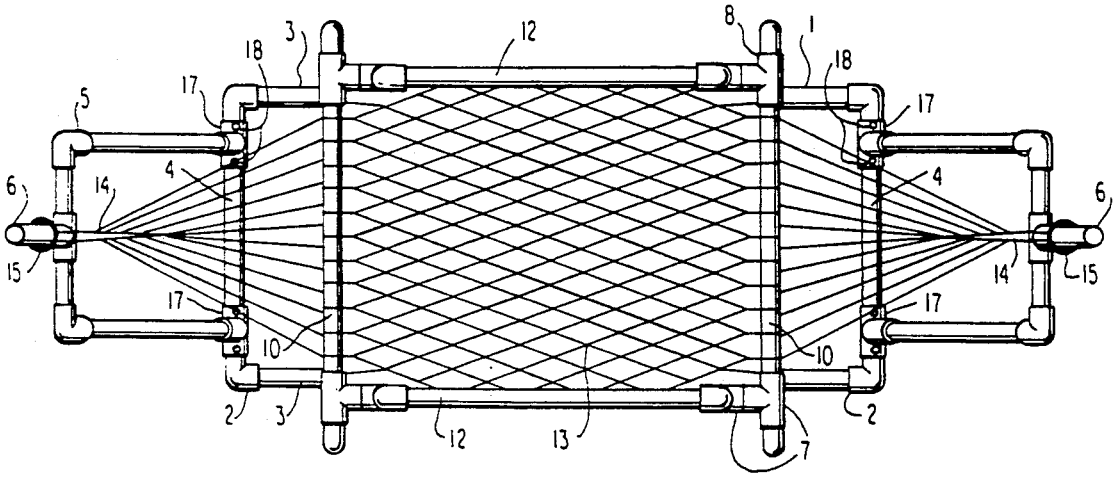
FIG. 1 depicts a top view of the portable infant suspender and assembly showing a bed formed of a netting material attached to a rectangular frame suspended above a slightly larger, rectangular frame of a supporting structure with extensions at opposing ends for attachment of opposite terminal junctures of a netting material.
Figure 2:
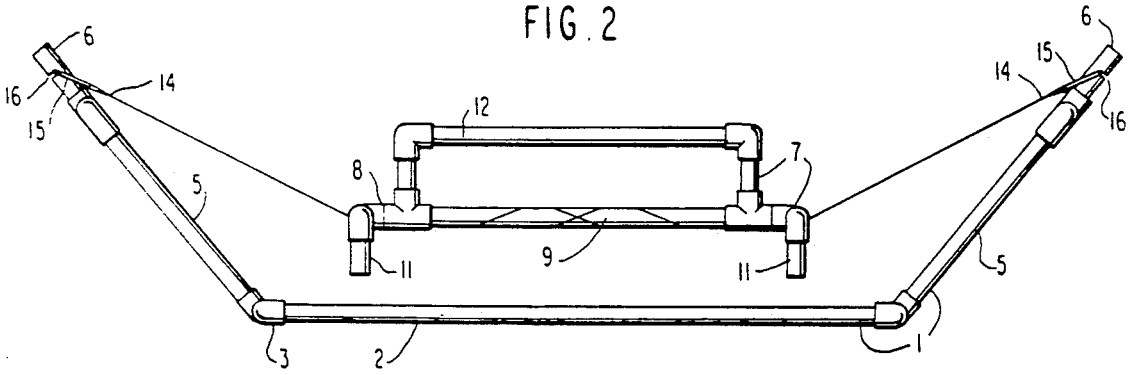
FIG. 2 depicts a side view of the portable infant suspender and assembly also showing the bed suspended above the supporting structure.
Figure 3:
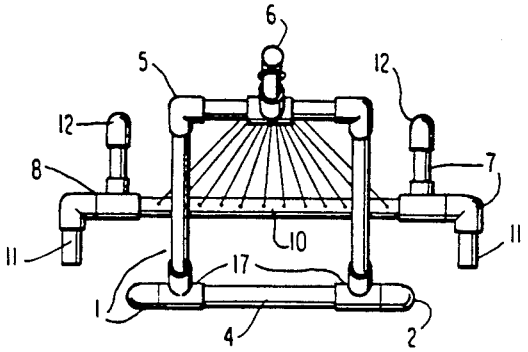
FIG. 3 is an end view of the portable infant suspender and assembly.
Figure 4:
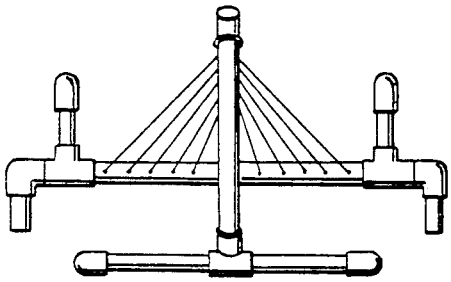
FIG. 4 is an alternative embodiment of an end view of the portable infant suspender and support assembly.
Figure 5:
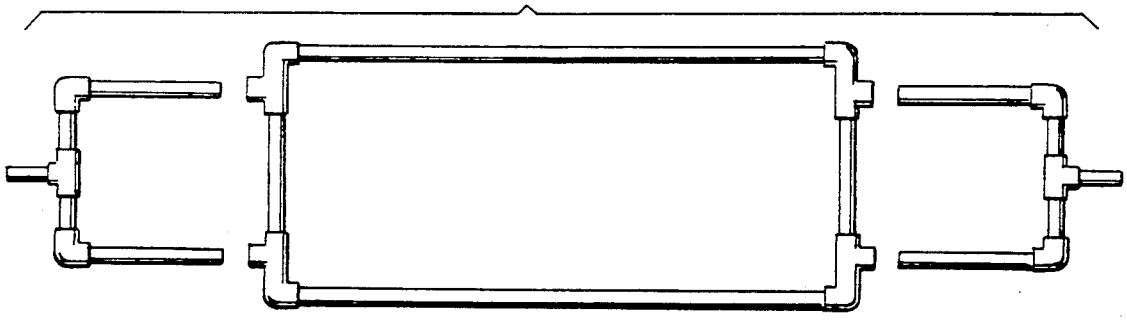
FIG. 5 depicts an exploded view of the portable infant suspender and support assembly with the bed/suspender detached from the support device and the extensions detached from the first rectangular frame.

In the disclosed embodiment of the invention portable infant suspender and assembly depicted in FIGS. 1-3, as earlier discussed, the reference numeral 1 generally designates a supporting/suspending stand structure comprising a first generally rectangular frame structure 2 with two lateral sides 3 and two end sides 4 lying in a horizontal plane. The reference numeral 5 designates extensions attached to each of the two opposing end sides 4 projecting upwardly and outwardly from the rectangular structure 2 at an angle of from about 91° to about 165°, preferably from about 105° to about 150°, and optimally about 135°. The extensions 5 may be formed by various means, including but not limited to a single post, an inverted "V" structure, or, as shown in FIGS. 1-3, an inverted "U" structure with an attachment provision 6 for assembly with (and suspension of) the bed 7.

The bed 7 is comprised of a second generally rectangular frame s with two lateral sides 9 and two end sides 10 and is suspended within a first horizontal plane lying above a second horizontal plane defined by the rectangular structure 2 of the supporting structure 1, when in assembly therewith. Preferably, the bed 7 is comprised further of at least one vertical stabilizer 11 projecting downward from each of the two sides 9 of the bed frame 8 to limit the degree of tilting on movement of the bed. Optimally, there is provided a vertical stabilizer 11 projecting downward from each of the four corners of the bed frame 8. For greatest efficiency, the vertical stabilizers 11 should be perpendicular to the bed frame 8 and should be of a length to permit clearance by the bed of the lateral sides 3 of the first rectangular frame 2 of the support stand 1 when the width of the bed frame 8 extends laterally beyond the width of said rectangular frame 2 without interfering with the suspension of the bed 7 by the support stand 1, when in assembly therewith. As a further safety feature, there are preferably provided horizontal rails 12 extending upward from lateral sides 9 of the bed 7 and extending over the majority of the length of each side 9.

Support for the infant (or a larger person in an upscaled version of the invention) is provided by a loosely woven netting material 13 stretched across the bed frame 8 and attached thereto along the lengths of lateral sides 9 and end sides 10 and projecting beyond end sides 10 to terminating junctures 14 for attachment to the opposing attachment provisions 6 on each extension 5 of the support/suspending structure 1.

Portability of the invention is provided first by simple disassembly, detaching the netting material terminating junctures 14 from attachment provisions 6 and, thereby, separating the bed 7 from the supporting/suspending stand 1. Portability is facilitated further by reducing the sizes of both components. Size reduction of the bed 7 is accomplished by folding each of the netting material projections to terminating junctures 14 inwardly to lie on the bed 7. Size reduction of the support stand 1 may be accomplished either by rotating each extension 5 inwardly toward the first rectangular frame 2 to lie approximately within its horizontal plane or by detaching the extensions 5 from end sides 3 of the first rectangular frame 2. After separation of the bed and support stand size reduction, the components may be stacked for easy transport.

A feature of the invention is the capability of employing the bed 7 separately from the suspending stand 1, although the invention claimed herein lies in the assembly thereof.

A variety of materials may be employed in the manufacture of the invention infant suspender and assembly. The framing elements for the bed 7 and the support stand 1, as well as extensions 5, attachment provisions 6, rails 12, and stabilizers 11, should be made of a rigid material such as wood, metal, or plastic. Consistent with desired portability, lightweight materials are preferred. Therefore, if the chosen material is metal, aluminum is preferred. In the most preferred embodiment of the invention, these framing elements are polyvinyl chloride (PVC) furniture pipes and fittings (such as elbows, "Ts", end caps, etc.).

The netting material 13 preferably may be formed of common twine which, in turn, may be formed of various natural or synthetic materials, such as cotton, wool, rayon, or, most preferably, nylon. Also, for convenience of assembly of the bed 7 with the suspending/supporting stand 1 by attachment of the netting material terminating junctures 14 to attachment provisions 6, said terminating junctures 14 may be fitted with wooden, metal, or plastic rings 15 of a slightly larger diameter than the attachment provisions 6 over which said rings 15 are placed. In a preferred embodiment of the invention, notches 16 are provided in attachment provisions 6 to accept said rings 15 for security of assembly.

In a preferred embodiment of the invention wherein portability is facilitated by permitting size reduction of the suspending stand 1 by detachment of extensions 5 from end sides 4 of the first rectangular frame 2, provision for said detachment is made by employment of PVC furniture pipe construction materials wherein said extensions 5 are removably attached to said end sides 4 by incorporation of "T" fittings 17 in said end sides 4 and wherein the outward angle of extension from the first rectangular frame 2 is fixed by securing the position of said "T" fittings 17 in said end sides 4 either by gluing or by screws 18 through the "T" fitting cross sections into the pipe units forming said end sides 4.

As noted earlier, the above description of the invention is not intended to be limiting as to the various alternative materials or designs which may be employed to result in that which is considered to be the subject matter of the invention; and the invention is intended to be limited only within the scope of the claims which follow.

What is claimed is:

1. A portable infant suspender and assembly comprising a suspending stand and a bed suspended from the suspending stand wherein the suspending stand is formed of a first rectangular frame comprised of two lateral sides and two end sides with an extension projecting upwardly and outwardly from each of the stand end sides and wherein the bed is formed of material stretched across a second rectangular frame comprised of two lateral sides and two end sides and extended beyond each of the bed end sides to terminating junctures of the extended material for attachment of the bed to the extensions of the suspending stand and wherein the bed is further comprised of at least one vertical stabilizer projecting downward from each bed lateral side.

2. The assembly of claim 1 wherein each of the extensions is formed by a single post structure.

3. The assembly of claim 1 wherein each of the extensions is formed by an inverted "U" structure.

4. The assembly of claim 1 wherein the extensions project upwardly and outwardly from the first rectangular frame at an angle of from about 91° to about 165°.

5. The assembly of claim 4 wherein the extension angle is from about 105° to about 150°.

6. The assembly of claim 5 wherein the extension angle is about 135°.

7. The assembly of claim 1 wherein each of the extensions terminate in an attachment provision to receive the terminating junctures.

8. The assembly of claim 7 wherein the first rectangular frame, the extensions, and the attachment provisions of the stand and the second rectangular frame, the vertical stabilizers, and the rails of the bed are made from a rigid material.

9. The assembly of claim 8 wherein the rigid material is selected from the group consisting of wood, metal, and plastic.

10. The assembly of claim 9 wherein the rigid material is the plastic polyvinyl chloride furniture pipe.

11. The assembly of claim 10 wherein the first rectangular end sides are provided with at least one "T" fitting for removable attachment of the extensions.

12. The assembly of claim 7 wherein the terminating junctures are fitted with rings formed of a material selected from the group consisting of wood, metal, and plastic and of a diameter slightly larger than that of the attachment provisions of the extensions and are secured in notches provided in the attachment provisions.

13. The assembly of claim 1 wherein the bed material is a netting material formed of twine.

14. The assembly of claim 13 wherein the twine is made from a material selected from the group consisting of cotton, wool, rayon, and nylon.

15. The assembly of claim 1 wherein the bed is further comprised of a vertical stabilizer projecting downward and perpendicular from each corner of the second rectangular frame.

16. The assembly of claim 1 wherein the bed is further comprised of horizontal rails extending upward from each of the bed lateral sides and extending along the majority of the length of each bed lateral side.

17. The assembly of claim 1 wherein the bed is suspended within a first horizontal plane formed by the second rectangular frame lying above a second horizontal plane formed by the first rectangular frame of the suspending stand.

18. The assembly of claim 1 wherein the bed is detached from the suspending stand and the suspending stand is reduced in size by detaching the extensions from the first rectangular frame.

* * * * *